US008601652B2

(12) United States Patent
Uehara et al.

(10) Patent No.: US 8,601,652 B2
(45) Date of Patent: Dec. 10, 2013

(54) SIDE RELEASE BUCKLE

(71) Applicant: YKK Corporation, Tokyo (JP)

(72) Inventors: Ryoichiro Uehara, Toyama (JP); Tomoko Yagami, Tokyo (JP); Yasutaka Nishida, Tokyo (JP); Takeshi Harada, Tokyo (JP); Kenichi Yoshie, Taipei (TW)

(73) Assignee: YKK Corporation (JP)

( * ) Notice: Subject to any disclaimer, the term of this patent is extended or adjusted under 35 U.S.C. 154(b) by 0 days.

(21) Appl. No.: 13/647,220

(22) Filed: Oct. 8, 2012

(65) Prior Publication Data

US 2013/0025097 A1 Jan. 31, 2013

Related U.S. Application Data

(63) Continuation of application No. 13/258,133, filed as application No. PCT/JP2009/071668 on Dec. 25, 2009.

(30) Foreign Application Priority Data

Mar. 31, 2009 (WO) ..... PCT/JP2009/056634

(51) Int. Cl.
*A44B 11/25* (2006.01)

(52) U.S. Cl.
CPC ..... *A44B 11/25* (2013.01); *A44B 11/2546* (2013.01)
USPC ..... 24/615; 24/625

(58) Field of Classification Search
USPC ..... 24/606, 614–616, 625, 700
See application file for complete search history.

(56) References Cited

U.S. PATENT DOCUMENTS 5,465,472 A * 11/1995 Matoba ..... 24/625
5,546,642 A * 8/1996 Anscher ..... 24/625

(Continued)

FOREIGN PATENT DOCUMENTS

CN 1398559 A 2/2003
CN 1911130 A 2/2007

(Continued)

OTHER PUBLICATIONS

International Search Report and Written Opinion, PCT International Patent Application No. PCT/JP2009/071668, mailed Apr. 6, 2010.

(Continued)

*Primary Examiner* — Robert J Sandy
*Assistant Examiner* — Tyler Johnson
(74) *Attorney, Agent, or Firm* — Kilpatrick Townsend & Stockton LLP

(57) ABSTRACT

A side release buckle includes a plug and a socket into which the plug is inserted for engagement. The plug includes: a base provided with a belt attachment; a pair of legs projecting from the base; an engaging portion formed to the legs; and a connecting portion connecting the legs to each other. The socket includes: a body provided with a belt attachment and an insertion opening; a housing space formed in the body and housing the legs inserted from the insertion opening; an engaged portion formed in the body and engageable with the engaging portion; and a cutout dented toward the insertion opening from an edge of the belt attachment. The cutout is formed over an area surrounded by the legs and the connecting portion when the legs and the connecting portion are housed in the housing space while the engaging portion and the engaged portion are engaged.

16 Claims, 8 Drawing Sheets

(56) References Cited

U.S. PATENT DOCUMENTS

| | | | | |
|---|---|---|---|---|
| 5,791,026 | A * | 8/1998 | Anscher | 24/615 |
| 6,052,875 | A * | 4/2000 | Fudaki | 24/625 |
| 6,148,486 | A * | 11/2000 | Uehara et al. | 24/170 |
| D471,486 | S * | 3/2003 | Uehara et al. | D11/216 |
| D483,293 | S | 12/2003 | Kawamura | |
| 6,728,999 | B2 * | 5/2004 | Murai et al. | 24/615 |
| D496,302 | S | 9/2004 | Fujimoto et al. | |
| 7,055,226 | B2 * | 6/2006 | Uehara et al. | 24/625 |
| D524,693 | S * | 7/2006 | Uehara et al. | D11/216 |
| 7,096,545 | B2 * | 8/2006 | Uehara et al. | 24/614 |
| 7,100,252 | B2 * | 9/2006 | Anscher | 24/615 |
| 7,111,368 | B2 * | 9/2006 | Matoba | 24/615 |
| 7,318,259 | B2 * | 1/2008 | Uehara | 24/615 |
| 7,320,160 | B2 * | 1/2008 | Uehara et al. | 24/615 |
| D564,408 | S | 3/2008 | Hsiao | |
| 7,346,965 | B2 | 3/2008 | Hsiao | |
| D576,519 | S * | 9/2008 | Uehara | D11/216 |
| D593,403 | S | 6/2009 | Salentine | |
| D597,441 | S * | 8/2009 | Uehara | D11/216 |
| 7,650,676 | B2 * | 1/2010 | Saitsu | 24/615 |
| D614,996 | S | 5/2010 | Huang | |
| D619,042 | S * | 7/2010 | Uehara | D11/216 |
| 7,979,966 | B2 * | 7/2011 | Yoshie | 24/615 |
| 8,112,850 | B2 * | 2/2012 | Uehara | 24/615 |
| D668,178 | S | 10/2012 | Kao | |
| 8,365,368 | B2 * | 2/2013 | Kaneko et al. | 24/625 |
| D684,089 | S * | 6/2013 | Nanbu et al. | D11/216 |
| D684,893 | S * | 6/2013 | Kataguchi et al. | D11/216 |
| D685,292 | S * | 7/2013 | Kataguchi et al. | D11/216 |
| 2002/0040514 | A1 * | 4/2002 | Uehara et al. | 24/614 |
| 2003/0014851 | A1 * | 1/2003 | Murai et al. | 24/615 |
| 2004/0055122 | A1 * | 3/2004 | Matoba | 24/615 |
| 2005/0091808 | A1 * | 5/2005 | Uehara et al. | 24/615 |
| 2005/0235469 | A1 | 10/2005 | Anscher | |
| 2005/0235470 | A1 * | 10/2005 | Uehara | 24/615 |
| 2006/0090310 | A1 * | 5/2006 | Uehara et al. | 24/614 |
| 2006/0168783 | A1 * | 8/2006 | Anscher | 24/615 |
| 2007/0186394 | A1 * | 8/2007 | Hsiao | 24/614 |
| 2007/0204441 | A1 * | 9/2007 | Saitsu | 24/614 |
| 2008/0178438 | A1 * | 7/2008 | Yoshie et al. | 24/616 |
| 2009/0007391 | A1 * | 1/2009 | Uehara | 24/32 |
| 2009/0056089 | A1 * | 3/2009 | Yoshie | 24/616 |
| 2010/0306976 | A1 * | 12/2010 | Kaneko et al. | 24/700 |
| 2011/0173783 | A1 * | 7/2011 | Kaneko | 24/615 |
| 2012/0017407 | A1 * | 1/2012 | Uehara et al. | 24/700 |
| 2012/0030913 | A1 * | 2/2012 | Uehara et al. | 24/606 |
| 2012/0198666 | A1 * | 8/2012 | Nanbu et al. | 24/608 |
| 2012/0227222 | A2 * | 9/2012 | Uehara et al. | 24/606 |
| 2012/0255144 | A1 * | 10/2012 | Gaudillere et al. | 24/303 |
| 2012/0260474 | A1 * | 10/2012 | Yoshie et al. | 24/642 |
| 2013/0031754 | A1 | 2/2013 | Uehara et al. | |

FOREIGN PATENT DOCUMENTS

| | | | |
|---|---|---|---|
| CN | 1973718 | A | 6/2007 |
| JP | 07-043568 | U | 9/1995 |
| JP | 2003-033209 | A | 2/2003 |
| JP | 2003-125810 | A | 5/2003 |
| JP | 2005-305112 | A | 11/2005 |
| JP | 2006-129952 | A | 5/2006 |
| JP | 2006-204911 | A | 8/2006 |
| JP | 200721224 | A | 2/2007 |
| JP | 1323896 | S | 3/2008 |
| JP | 2008-178570 | A | 8/2008 |
| JP | 2009-011492 | A | 1/2009 |
| JP | 2009-18003 | A | 1/2009 |
| JP | 2009-061050 | A | 3/2009 |

OTHER PUBLICATIONS

International Search Report and Written Opinion, PCT International Patent Application No. PCT/JP2009/056634, mailed Jul. 7, 2009.

Office Action, Japanese Patent Application No. 2011-506874, mailed Oct. 30, 2012.

Office Action, Japanese Patent Application No. 2011-506969, mailed Oct. 30, 2012.

Office Action, Japanese Patent Application No. 2011-506969, mailed Apr. 2, 2013.

Office Action, U.S. Appl. No. 13/258,133, mailed May 23, 2013.

Office Action, Chinese Patent Application No. 200980158243.5, mailed Aug. 2, 2013.

Office Action, Chinese Patent Application No. 200980158242.0, mailed Aug. 5, 2013.

* cited by examiner

SIDE RELEASE BUCKLE

RELATED APPLICATIONS

This application is a continuation of U.S. patent application Ser. No. 13/258,133 filed on Sep. 21, 2011 entitled "Side Release Buckle," which is a national stage application of PCT/JP2009/071668 filed Dec. 25, 2009, which claims priority to PCT/JP2009/056634 filed Mar. 31, 2009, all of which are incorporated herein by reference.

TECHNICAL FIELD

The present invention relates to a side release buckle configured to, for instance, connect belts, the side release buckle including a pair of lock arms on both sides thereof.

BACKGROUND ART

There has been typically used a buckle that detachably engages a plug with a socket in order to couple string members (e.g., belts) in various applications (e.g., clothes, bags, shoes and packages).

Such a buckle requires easy handling for coupling and releasing as well as no accidental release when the buckle is not intended to be released. As a product that satisfies such needs, a side release buckle including a pair of lock arm on both sides thereof has been used.

For instance, a side release buckle disclosed in Patent Literature 1 or 2 includes a plug and a socket, each of which is provided with a belt attachment.

The plug includes a base including the belt attachment and a pair of legs (lock arms) on both sides near the socket. The socket includes a hollow cylindrical body, the body having a housing space (cavity) into which the plug is inserted from a plug-facing side of the body. An opening in communication with the housing space is formed on each side of the body of the socket. The plug and the socket can be disengaged by manipulating the legs exposed through the openings with fingers.

Among the above side release buckles, the side release buckle disclosed in Patent Literature 1 includes a prismatic guide bar between a pair of legs of the plug in order to stabilize a posture of the plug when the plug is inserted into the socket.

On the other hand, in the side release buckle disclosed in Patent Literature 2, a guiding function of a pair of legs is enhanced, whereby a guide bar is omitted. However, the side release buckle disclosed in Patent Literature 2 additionally includes a connecting belt configured to connect the pair of legs. The connecting belt, which is a member shaped in a thin plate, is integrally formed with the legs and the like. The connecting belt connects the pair of legs while being curved in a substantially U-shape. The connecting belt is configured to suppress excessively outward deformation of the legs to prevent breakage thereof.

CITATION LIST

Patent Literature

Patent Literature 1 JP-A-2008-178570
Patent Literature 2 JP-A-2009-011492

SUMMARY OF THE INVENTION

Problems to be Solved by the Invention

These days, weight reduction of a buckle such as a side release buckle has been expected.

Since the entire side release buckle has already been molded in one piece by using a resin, weight reduction of the buckle is difficult in view of a material (the resin). For this reason, it has been demanded to reduce the material for each portion constituting the buckle.

From this point of view, the buckle disclosed in Patent Literature 2 in which the guide bar is omitted is more suitable for weight reduction than the buckle disclosed in Patent Literature 1 in which the plug is provided with the guide bar. On the other hand, there is a limit to thin the socket for reducing the material used for the socket because press strength of the socket needs to be secured. Accordingly, an arrangement of the buckle for achieving further weight reduction has been demanded.

An object of the invention is to provide a side release buckle with a reduced weight and a secured strength.

Means for Solving the Problems

According to an aspect of the invention, a side release buckle includes: a plug; and a socket into which the plug is inserted for engagement, in which the plug includes: a base being provided with a belt attachment; a pair of legs projecting from the base; an engaging portion being formed to each of the legs; and a connecting portion configured to connect the legs to each other, the socket includes: a body being provided with a belt attachment and an insertion opening; a housing space being formed in the body and capable of housing the legs inserted from the insertion opening; an engaged portion being formed in the body and engageable with the engaging portion; and a cutout being formed from an edge of the belt attachment toward the insertion opening, and the cutout is formed over an area surrounded by the pair of legs and the connecting portion when the pair of legs and the connecting portion are housed in the housing space while the engaging portion and the engaged portion are engaged.

According to the above aspect of the invention, a surface area of the body of the socket can be decreased by forming the cutout on the body to reduce a material for the body even with the same thickness as that of a body without a cutout. Accordingly, a weight of the buckle can be reduced.

While the engaging portion and the engaged portion are engaged, in other words, the plug is fit in the socket (in a normal coupling state), this cutout is formed by cutting out an interior of an area surrounded by the pair of legs and the connecting portion, for instance, in a concave shape. Since the cutout is thus formed, the pair of legs and the connecting portion are not exposed outward. Accordingly, while the weight of the buckle is reduced by the cutout, appearance quality is not deteriorated. The buckle can rather provide a lightweight impression since the buckle has increased open parts. Moreover, since neither the pair of legs nor the connecting portion comes out of the cutout, the legs or the connecting portion is prevented from being caught by other articles.

According to the above aspect of the invention, an outline of the cutout 25 is formed along an inner shape of the pair of legs and the connecting portion.

With this arrangement, the maximum cutout area can be formed such that neither the pair of legs nor the connecting portion is exposed out of the cutout, thereby realizing the maximum weight reduction.

According to the above aspect of the invention, an edge of the cutout near the insertion opening is formed to have a C-shape or U-shape outline.

With this arrangement, the cutout near the insertion opening is formed to have an outline in a C-shape (when the cutout is shallow) or in a U-shape (when the cutout is deep), whereby the outline of the cutout fits with an inner shape (typically, a C-shape or a U-shape) of the connecting portion and the legs of the plug. Since the innermost part of the cutout is shaped in an arc (a C-shape or a U-shape), the outline of the cutout has no steeply angled discontinuous portion, so that stress concentration and difficulties in formation can be avoided.

According to the above aspect of the invention, a protrusion projecting into the housing space is formed inside the body, and the protrusion is continuously formed along the edge of the cutout near the insertion opening.

With this arrangement, when the legs of the plug are inserted from the insertion opening for coupling, a tip end of the leg or the engaging portion is prevented from being exposed out of the cutout, and a pair of engaging portions are respectively guided to the engaged portions, whereby the plug can be smoothly inserted into the socket.

According to the above aspect of the invention, another cutout is formed in the body from the insertion opening toward the belt attachment.

With this arrangement, since the cutouts are provided near the belt attachment and near the insertion opening, the material for the body is minimized, so that production costs and the weight thereof can be reduced at the maximum.

Since the cutout near the belt attachment is formed deep and the cutout near the insertion opening is formed shallow, a remaining portion between the cutouts (a portion connecting left and right sides of the body) is positioned remote from the belt attachment (which also connects the left and right sides of the body), whereby torsional rigidity of the body can be attained.

DESCRIPTION OF EXEMPLARY EMBODIMENTS

Exemplary embodiments of the invention will be described below with reference to the attached drawings.

First Exemplary Embodiment

FIGS. 1 to 9 show a first exemplary embodiment of the invention.

Figure 1:
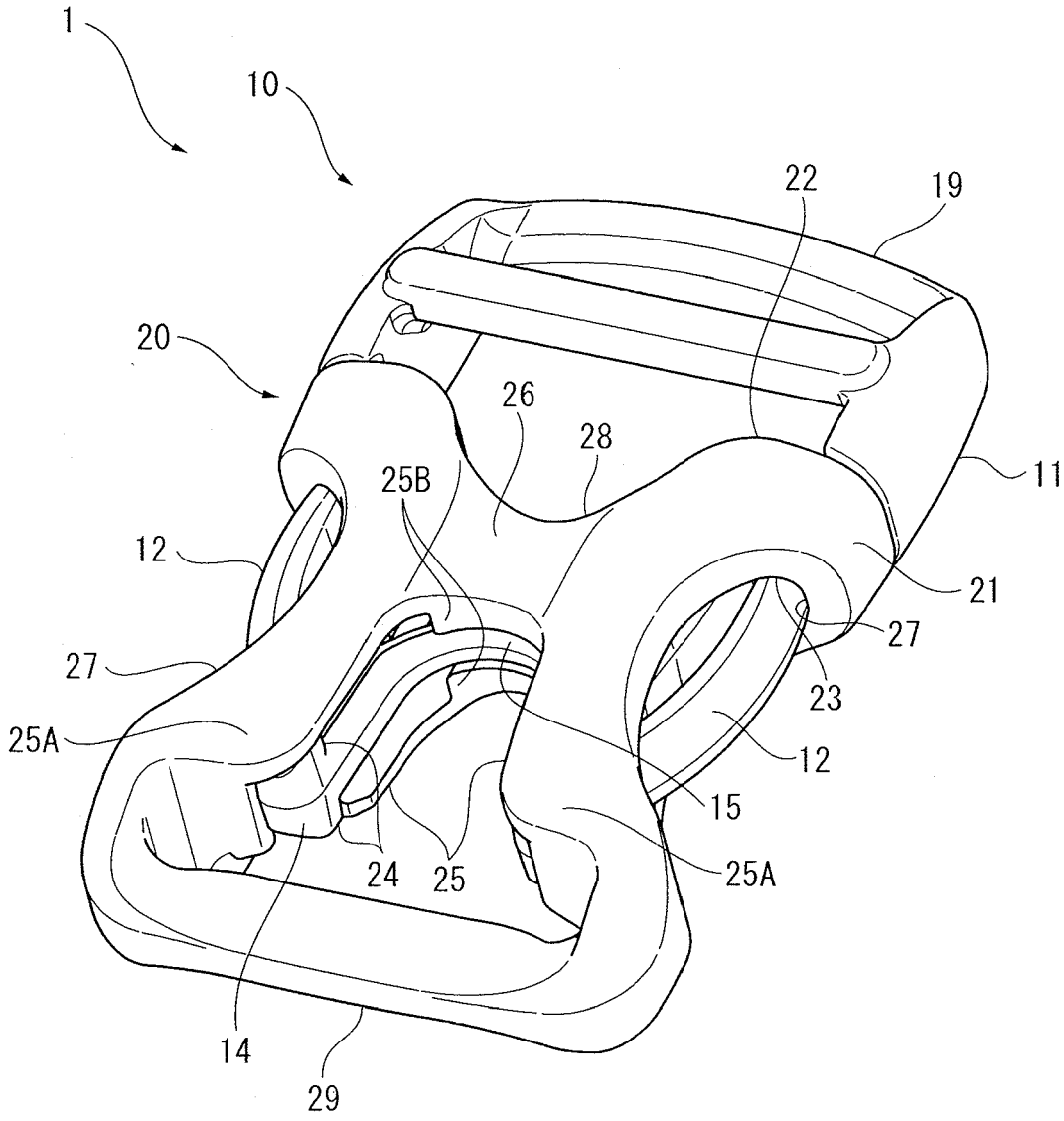
FIG. 1 is a perspective view showing a top surface of a side release buckle according to a first exemplary embodiment of the invention.
Figure 2:
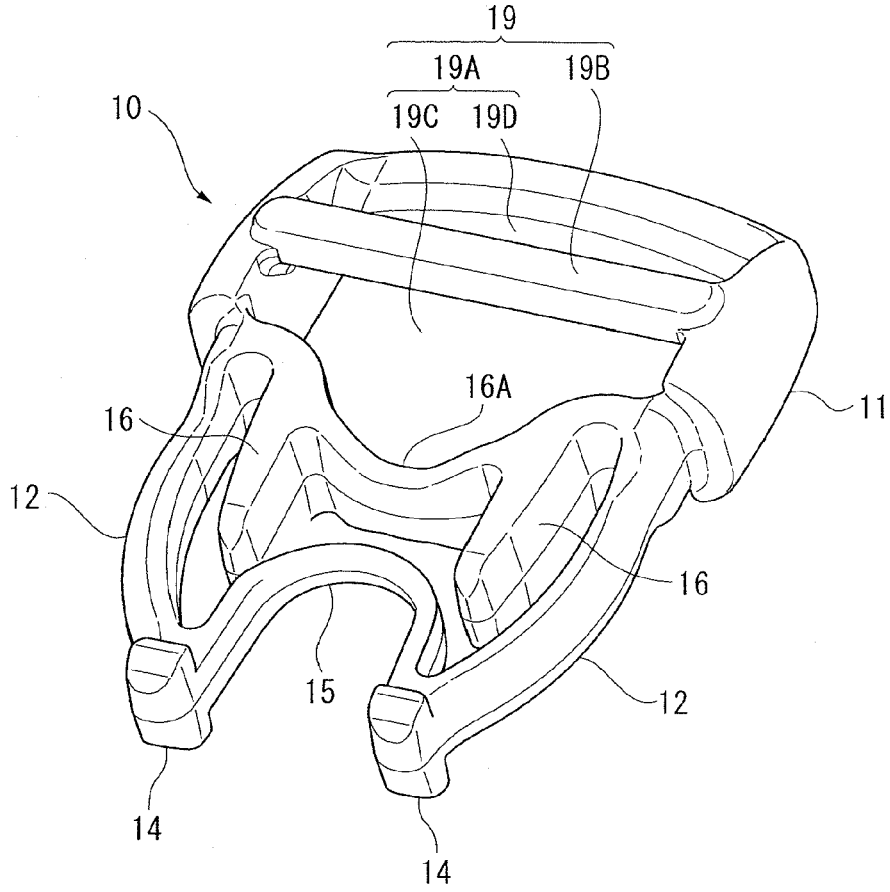
FIG. 2 is a perspective view showing a top surface of a plug according to the first exemplary embodiment.
Figure 3:
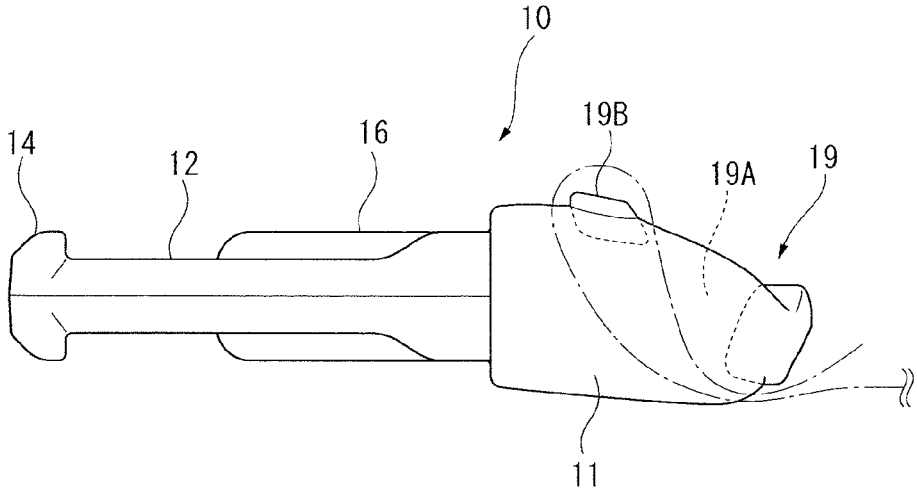
FIG. 3 is a lateral side view showing the plug according to the first exemplary embodiment.

As shown in respective FIGS. 1 to 3, a side release buckle 1 according to this exemplary embodiment includes a plug 10 and a socket 20 into which the plug 10 is inserted for engagement.

As shown in the figures, the side release buckle 1 according to the first exemplary embodiment is used to couple and release ends of a string member. The buckle 1 includes the plug 10 integrally formed of a synthetic resin and the socket 20 also integrally formed of a synthetic resin. The plug 10 and the socket 20 may be formed of other materials such as metal in addition to the synthetic resin by other forming methods in addition to an injection forming.

In FIGS. 1 and 2, the entirety of the plug 10 is integrally formed of the synthetic resin by an injection forming. The plug 10 includes a base 11 having a belt attachment 19 and a pair of legs 12, and an engaging portion 14 provided to each of the legs 12.

The legs 12 extend in a lengthwise direction (an insertion direction of the plug 10 to the socket 20, i.e., a vertical direction in FIG. 1) from both sides of the base 11 in a widthwise direction (a direction orthogonal to the insertion direction of the plug 10 to the socket 20 and a top-bottom direction of the socket 20, i.e., a horizontal direction in FIG. 1). The legs 12 are parallel to each other. A portion from the center to the tip end of each of the legs 12 is elastically deformable in a direction separating from each other or in a direction approaching each other (the above-described widthwise direction).

The pair of legs 12 are gradually inclined in the direction approaching each other toward the tip ends of the legs 12 in the insertion direction and are curved with a predetermined clearance. Accordingly, the legs 12 can entirely receive elastic deformation force.

The engaging portion 14 is formed as a projection extending upward and downward (the top-bottom direction of the socket 20) from the tip end of each of the legs 12. The tip end of each of the legs 12 is T-shaped in a lateral side view. In other words, the engaging portion 14 is formed to the tip end of each of the legs 12 and a dimension in a top-bottom direction (a height) of the engaging portion 14 is formed larger than a height of each of the legs 12.

The belt attachment 19 is formed in a middle part of the base 11.

As shown in FIG. 2, the belt attachment 19 includes a string attachment hole 19A (a string attachment portion) into which an end of the string member is inserted to be locked at an internal center thereof, and a connecting bar 19B formed across the string attachment portion in a middle of the string attachment portion. The connecting bar 19B divides the string attachment hole 19A into a front hole 19C and a rear hole 19D in the insertion direction. With this arrangement, a length of the string member can be adjusted by winding the string member around the connecting bar 19B after inserting the string member through the string attachment hole 19A.

In FIG. 2, tip ends of the pair of legs 12 are connected by a U-shaped connecting portion 15.

The connecting portion 15 has portions that extend from the engaging portions 14 of the tip ends of the legs 12 toward the belt attachment 19 and approach each other to be connected, so that the connecting portion 15 is formed in a U-shape. The connecting portion 15 prevents the pair of legs 12 from being excessively expanded by external force.

A pair of guided portions 16 are provided between the pair of legs 12.

As shown in FIG. 3, each of the guided portions 16 has the same height as that of the engaging portion 14 of the tip end of each of the legs 12. An upper edge of each of the guided portions 16 projects upward beyond an upper edge of each of the legs 12 while a lower edge of each of the guided portions 16 projects downward beyond a lower edge of each of the legs 12. The engaging portions 14 and the guided portions 16 are guided by an undulation (described later) formed inside the socket 20, whereby the plug 10 is led to an appropriate position in an insertion operation.

As shown in FIG. 2, the guided portions 16 are connected to each other via a connecting frame 16A near the base 11. The connecting frame 16A connects opposing portions of the guided portions 16 near the base 11. A middle portion of the connecting frame 16A is curved in a manner to project in the insertion direction of the plug 10. The middle portion of the connecting frame 16A is formed to have a height in a top-bottom direction lower than a height of each of the guided portions 16. The height is increased at a position closer to ends of the connecting frame 16A and reaches the height of each of the guided portions 16 at the ends of the connecting frame 16A. Thus, top and bottom surfaces of the connecting frame 16A are gradually dented at respective centers thereof. This profile corresponds to an outline of the linear convex 26B formed on an inner surface of a body 21 (described later).

Figure 4:
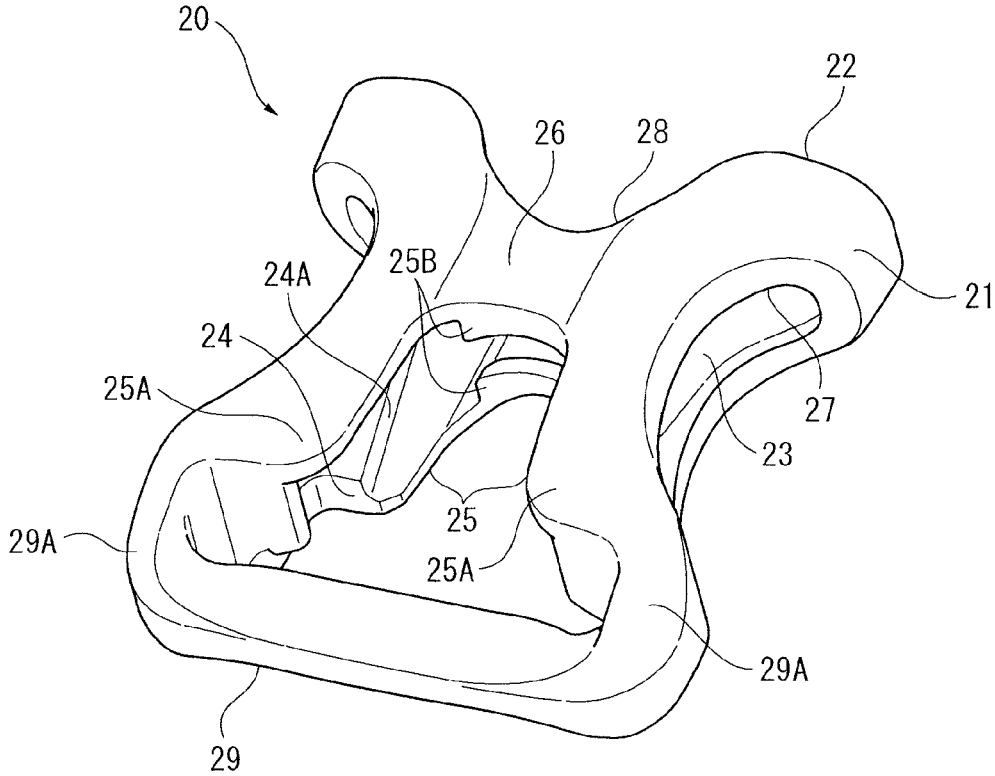
FIG. 4 is a perspective view showing a top surface of a socket according to the first exemplary embodiment.

In FIGS. 1 and 4, an entirety of the socket 20 is integrally formed of a synthetic resin by an injection forming. The socket 20 includes: the hollow cylindrical body 21 including a belt attachment 29 and an insertion opening 22; a housing space 23 being formed in the body 21 and capable of housing the legs 12 of the plug 10 inserted from the insertion opening 22; and an engaged portion 24 being formed in the body 21 and engageable with the engaging portion 14.

As shown in FIG. 4, the engaged portions 24 are formed from steps that are formed at four positions inside the housing space 23 and face the belt attachment 29 (in a direction opposite to the insertion opening 22). Two of the four steps (the engaged portions 24) are formed on an inner side of the bottom surface of the body 21 and face the housing space 23 and lateral portions 29A of the belt attachment 29 of the body 21.

Among the four steps, an opposing pair of steps respectively on the top and bottom surfaces provide the engaged portions 24. In the socket 20 according to this exemplary embodiment, a pair of the engaged portions 24 aligned in a width direction are provided and correspond to the engaging portions 14 formed to the pair of legs 12.

A leading surface 24A is formed in the housing space 23 for leading the engaging portion 14 to the engaged portion 24 for engagement.

The leading surface 24A is a step continuously formed from a vicinity of each lateral end of the insertion opening 22 to the engaged portion 24 along an inner side of each of the top and bottom surfaces of the body 21. When the legs 12 are inserted from the insertion opening 22, the leading surfaces 24A function as a guide configured to lead the engaging portions 14 at the tip ends of the legs 12 to the engaged portions 24. In other words, the engaging portions 14, which are located at the tip ends of the legs 12 inserted from the insertion opening 22, are led along the leading surfaces 24 and approach each other when the pair of legs 12 are elastically deformed. When the engaging portions 14 reach the engaged portions 24, the legs 12 elastically deformed by the leading surfaces 24A are recovered, so that the engaging portions 14 fit in the engaged portions 24 for mutual engagement.

On the other hand, in order to disengage the engaging portions 14 from the engaged portions 24, a manipulation opening 27 is formed on the body 21. The manipulation opening 27 is formed on each of lateral sides of the body 21 and communicates with the housing space 23 inside the body 21. The manipulation opening 27 is positioned to expose a middle portion of each of the legs 12 inserted from the insertion opening 22. By pressing inward the legs 12 exposed out of the manipulation openings 27, the pair of legs 12 are elastically deformed to approach each other, whereby the engaging portions 14 are disengaged from the engaged portions 24 for mutual disengagement.

The body 21 includes an undulation 26 continuously formed in an insertion direction of the legs 12 substantially on a center of each of the top and bottom surfaces of the body 21.

Figure 5:
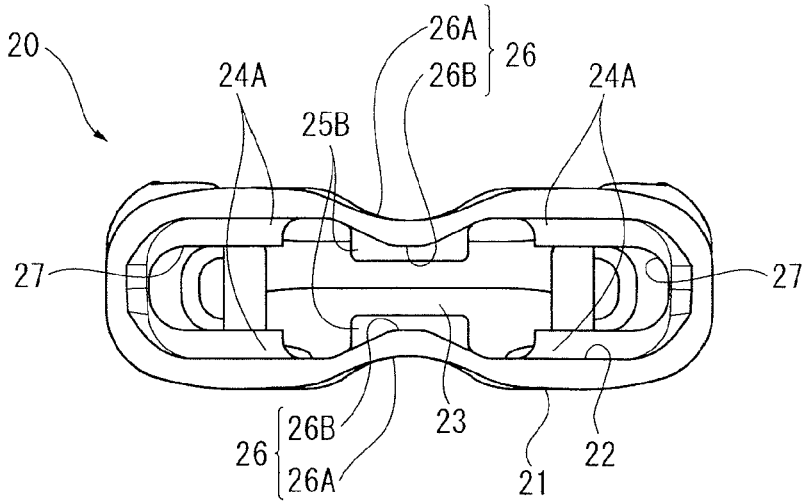
FIG. 5 is a front view showing an insertion opening of the socket according to the first exemplary embodiment.

As shown in FIG. 5, the undulation 26 is provided by a linear concave 26A formed on an outer surface of the body 21 and a linear convex 26B formed on an inner surface of the body 21 along the linear concave 26A. A thickness of a portion sandwiched by the linear concave 26A and the linear convex 26B is the same as those of other portions of the body 21. In other words, the undulation 26 is cross-sectionally a corrugated plate provided by curving a part of a flat plate.

The undulation 26 is formed on each of the top and bottom surfaces of the body 21, whereby the body 21 is formed like a corrugated plate curved in a direction in which the centers of the opposing top and bottom surfaces approach. With this arrangement, strength is secured substantially at the centers where press force working in the top-bottom direction is most likely to be applied and cracks are likely to generate, and thus crush and cracks are effectively prevented.

The undulations 26 are positioned on the top and bottom surfaces of the body 21 to correspond to each other. The linear convexes 26B of the undulations 26 are positioned to fit in respective dents on the top bottom surfaces of the connecting frame 16A between the legs 12 inserted into the housing space 23. A gap between the linear convexes 26B is set smaller than the height of each of the engaging portions 14 and the height of each of the guided portions 16 (the dimension in the top-bottom direction). When the legs 12 are inserted, the engaging portions 14 and the guided portions 16 are guided along the undulation 26. The undulation 26 provides a guiding function to suitably guide the engaging portions 14 to the engaged portions 24 while adjusting a posture of the plug 10. At this time, owing to the dents on the top and bottom surfaces, the connecting frame 16A between the guided portions 16 can be inserted into the gap of the linear convexes 26B without interference with the linear convexes 26B.

A height of the housing space 23 into which each of the guided portions 16 is introduced is formed to fit with the height of each of the guided portion 16. While the guided portions 16 remain inserted in the housing space 23, when the socket 20 is pressed in the top-bottom direction, the guided portions 16 support the socket 20 and prevent excessive deformation such as crush in the top-bottom direction.

Figure 6:
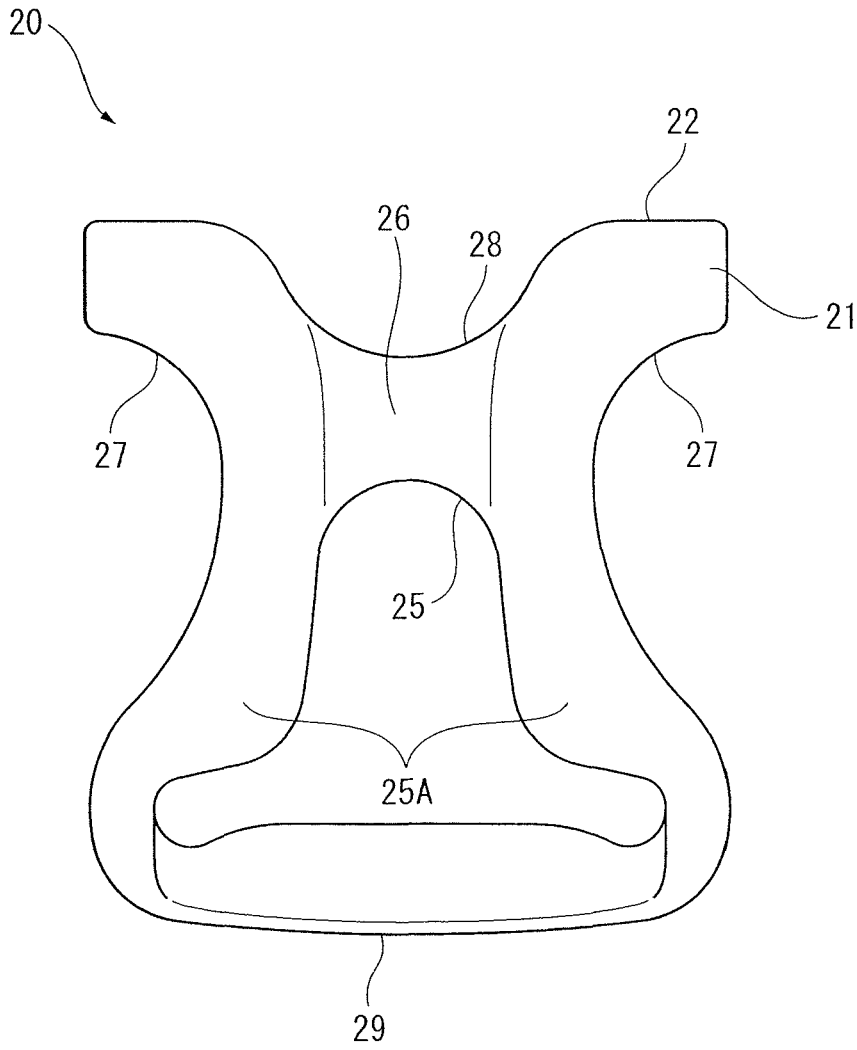
FIG. 6 is a plan view showing a top surface of the socket according to the first exemplary embodiment.
Figure 7:
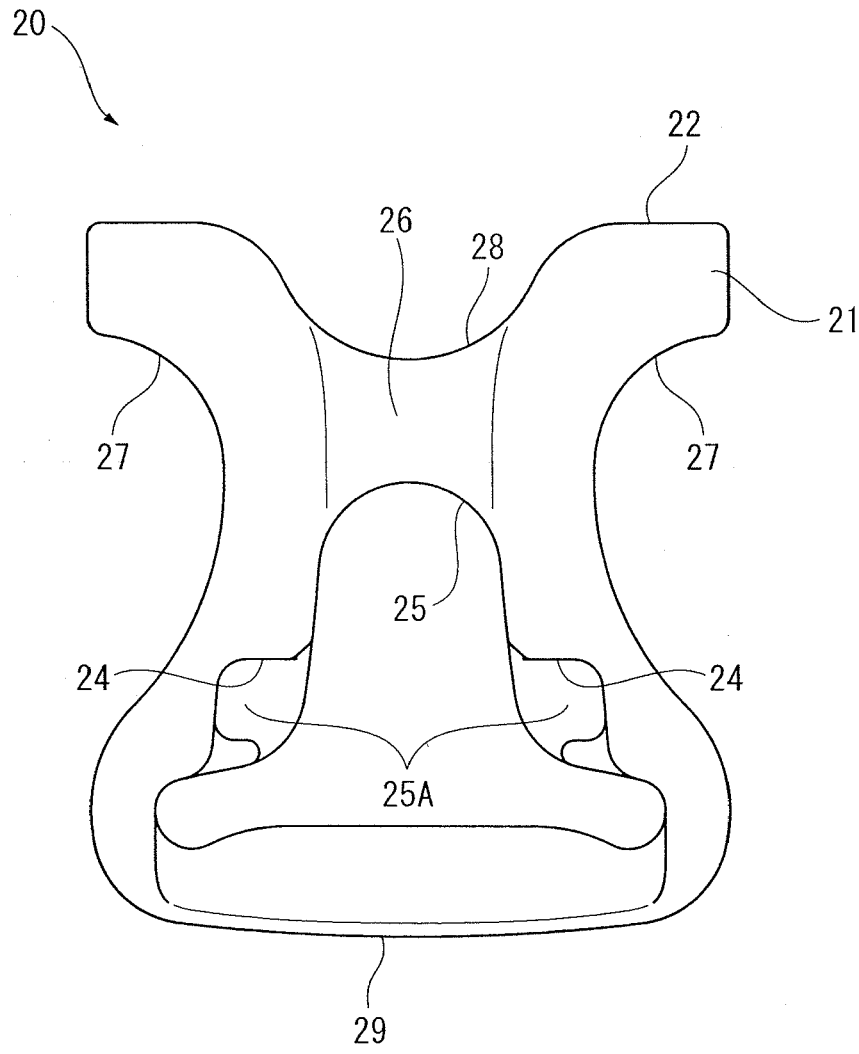
FIG. 7 is a plan view showing the bottom surface of the socket according to the first exemplary embodiment.
Figure 8:
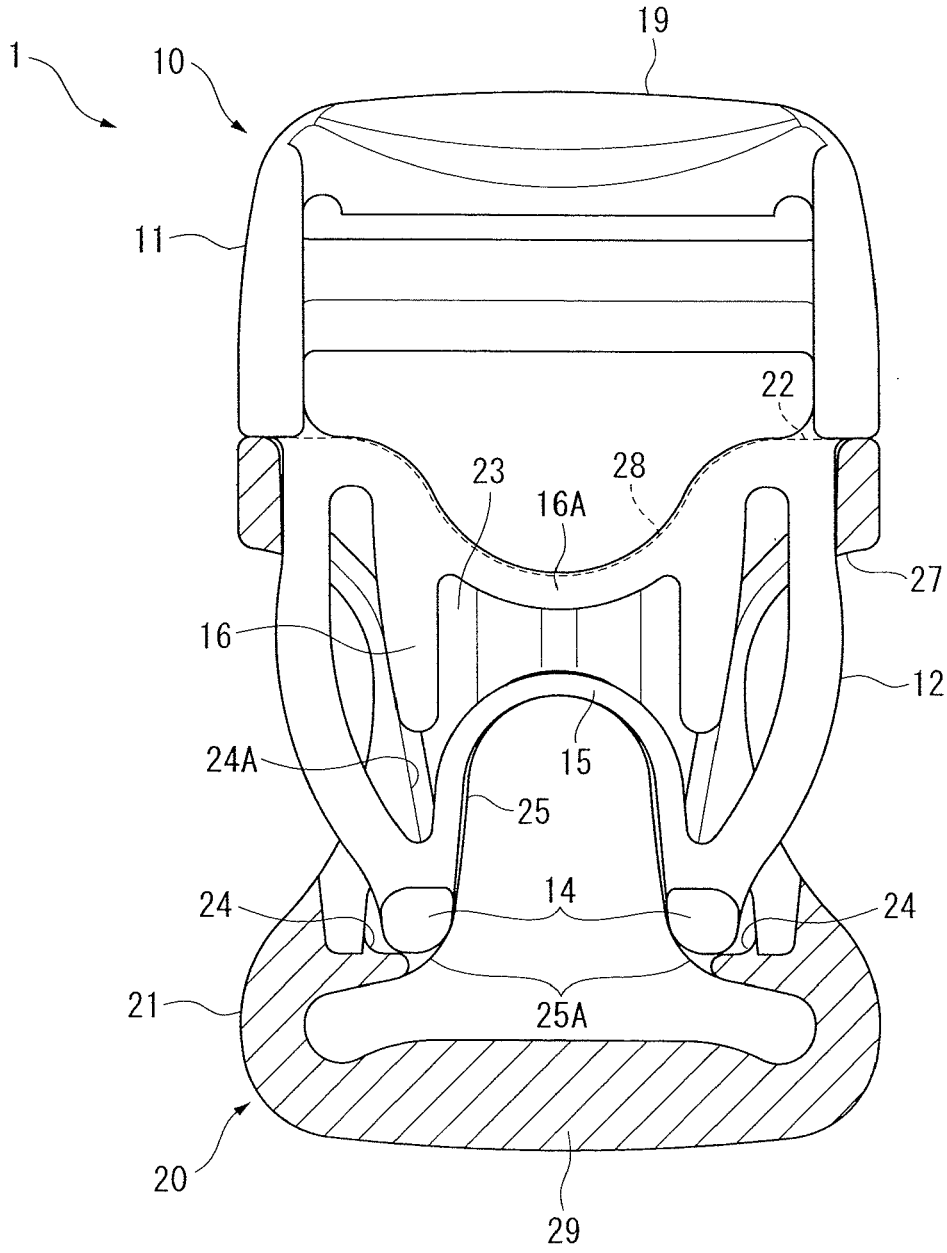
FIG. 8 is a cross sectional view showing engagement according to the first exemplary embodiment.

As shown in FIGS. 6, 7 and 8, a cutout 28 and a cutout 25 are provided on each of the top and bottom surfaces of the body 21. The cutout 28 is formed such that the center of a widthwise edge of the insertion opening 22 is dented toward the belt attachment 29. The cutout 25 is formed such that the center of a widthwise edge of a belt-insertion opening near the belt attachment 29 is dented toward the insertion opening 22.

The cutout 28 is a C-shaped shallow cutout extending from the insertion opening 22. While the innermost part of the cutout 28 is shaped in an arc, a part thereof connected to an edge of the insertion opening 22 is also shaped in a smooth arc. Such a smooth shape, namely, a shape without sharp irregularities prevents stress concentration on a specific part by external force and the like.

A C-shaped edge of the cutout 28 forms an outline along an inner shape of the connecting frame 16A formed to the base 11 of the plug 10. With this outline, while the cutout 28 is maximally enlarged, the base 11 is not exposed more than necessary.

With this arrangement of the cutouts 28, while the plug 10 and the socket 20 are engaged, a continuous through-hole is formed. The through-hole extends between the connecting frame 16A and the connecting bar 19B of the plug 10 from the cutout 28 on the top surface of the socket 20 to the cutout 28 on the bottom surface. The through-hole is shaped such that a distance of the through-hole in a width direction of the socket 20 is gradually decreased toward the insertion direction of the plug 10.

The cutout 25 is a U-shaped deep cutout extending from the belt attachment 29. While the innermost part of the cutout 25 is shaped in an arc, a part of the cutout 25 continuous to an edge thereof opposing the belt attaching 29 is also shaped in a smooth arc. The part is a later-described projection 25A on the top surface and is an end edge of the engaged portion 24 on the bottom surface. Such a smooth shape, namely, a shape without sharp irregularities prevents stress concentration on a specific part by external force and the like.

A U-shaped edge of the cutout 25 forms an outline along an outer shape of the legs 12 and the connecting portion 15. As described above, the tip ends of the pair of legs 12 are connected to each other by the connecting portion 15 to form a U-shaped inner shape in an entirety. The outline of the cutout 25 is formed in line with this shape. With this outline, while the cutout 25 is maximally enlarged, the legs 12 and the connecting portion 15 are not exposed.

With this arrangement of the cutout 25, while the plug 10 and the socket 20 are engaged, a continuous through-hole is formed. The through-hole extends between the pair of legs 12 and the connecting portion 15 of the plug 10 from the cutout 25 on the top surface of the socket 20 to the cutout 25 on the bottom surface. The through-hole is shaped such that a distance of the through-hole in a width direction of the socket 20 is gradually decreased toward a direction (a pulling direction of the plug 10) opposite to the insertion direction of the plug 10.

In the cutout 25 formed on the top surface of the body 21 among the cutouts 25, portions facing both edges of the belt attachment 29 are provided as projections 25A projecting along the belt attachment 29. The above-described engaged portions 24 near the top surface are covered by the projections 25A. The projections 25A prevent the belt inserted in the belt attachment 29 from being improperly lifted up.

The cutout 25 formed on the bottom surface of the body 21 includes no portion corresponding to the projections 25A. Apart of an edge of the cutout 25 is formed along the step of each of the engaged portions 24, so that the engaged portions 24 are exposed from the bottom surface of the body 21.

Figure 9:
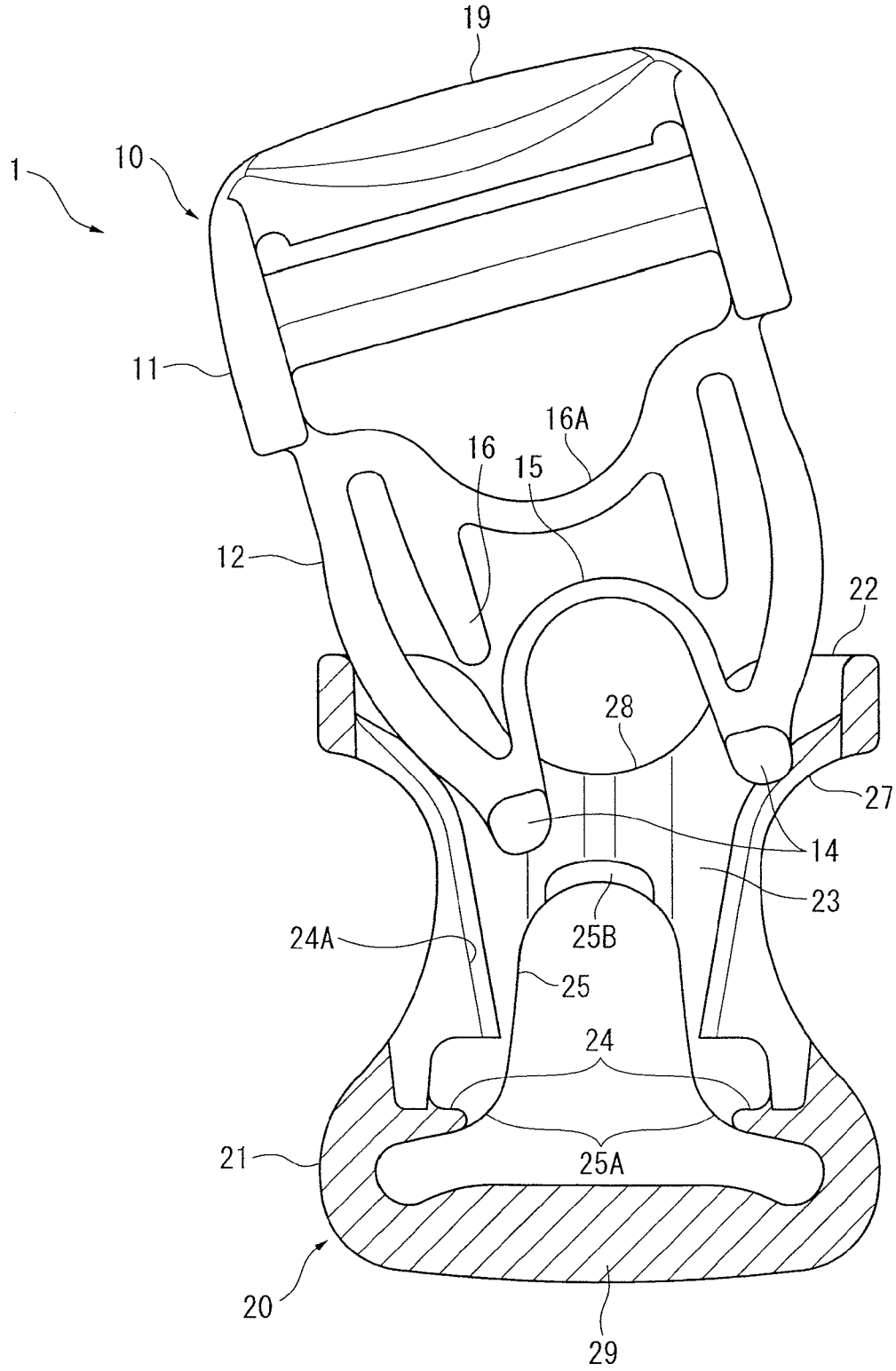
FIG. 9 is a cross sectional view showing a state where the plug is inserted while being tilted according to the first exemplary embodiment.

As shown in FIGS. 1, 4 and 9, a protrusion 25B projecting into the housing space 23 is formed on an inner side of each of the top and bottom surface of the body 21.

The protrusion 25B is a continuous protrusion having a substantially rectangular cross section and being integrally formed with the body 21. The protrusion 25B is continuously formed along the edge of the cutout 25 near the insertion opening 22. On the edge of the cutout 25, the protrusion 25B extends over a predetermined widthwise area from the center of the edge of the cutout 25 near the insertion opening 22 toward both ends thereof. This area corresponds to a part of an area through which the tip end of one of the legs 12 (the engaged portion 14) is likely to enter the cutout 25 when the legs 12 of the plug 10 are inserted from the insertion opening 22 of the socket 20 for coupling. This area is determined to be sufficient to block the engaging portion 14 when, for instance, the plug 10 is excessively tilted relative to the insertion direction (see FIG. 9) and thus the engaging portion 14 becomes excessively close to the center axis of the socket 20, thereby preventing the plug 10 from being inserted into the socket 20 while being excessively tilted.

A height of the protrusion 25B is set such that a gap between the opposing protrusions 25B on the top and bottom surfaces is slightly larger than a height of the connecting portion 15 of the plug 10. Accordingly, when the plug 10 is inserted into the socket 20, the connecting portion 15 is provided between the protrusions 25B on the top and bottom surfaces. With this arrangement, while the plug 10 is coupled with the socket 20, the protrusions 25B on the top and bottom surfaces are aligned with the connecting portion 15, which gives a simple appearance.

As shown in FIG. 4, a height of the lateral portions 29A of the belt attachment 29 of the body 21 is larger than that of a belt-winding portion of the belt attachment 29, whereby a sufficient connection strength is attained.

In this exemplary embodiment, the following advantages will be obtained.

Since the cutouts 25 and 28 are formed on the top and bottom surfaces of the body 21, the cutouts 25 and 28 respectively extending from the edges of the belt attachment 29 and the insertion opening 22 along the undulations 26, the material for the socket 20 can be further reduced, whereby reduction in production costs and the weight is further promoted.

Since the cutouts 25 and 28 are respectively formed to have a U-shaped or C-shaped shallow outline, the outlines of the cutouts 25 and 28 have no steeply angled discontinuous portion, so that stress concentration and difficulties in formation can be avoided.

Since the outlines of the cutouts 25 and 28 respectively fit with the legs 12 and the connecting portion 15 housed in the housing space 23 or the opening of the belt attachment 19, each of the cutouts can have the maximum area while the legs 12 and the connecting portion 15 are reliably covered.

The body 21 is provided with the cutout 25 extending from the belt attachment 29 and the cutout 28 extending from the insertion opening 22. Such provision of the cutouts near the belt attachment 29 and the insertion opening 22 can minimize the material for the body 21, thereby maximally reducing the production costs and the weight thereof.

For instance, an experimental result shows that an approximately 10% reduction in weight is achieved when the cutouts 25 and 28 are formed on an existing buckle.

Since the cutout 25 near the belt attachment 29 is formed deep and the cutout 28 near the insertion opening 22 is formed shallow, a remaining portion between the cutouts (a portion connecting left and right sides of the body 21) is positioned remote from the belt attachment 29 (similarly, connecting left and right sides of the body 21). Accordingly, while torsional rigidity of the body 21 can be attained, the guiding function for the legs 12 by the undulation 26 formed on the remaining portion can work at an earlier stage of the insertion operation.

The cutout 25 is provided with the projections 25A projecting along the belt attachment 29 at the portions facing both the ends of the belt attachment 29. Accordingly, the projections 25A can prevent the belt put into the belt attachment 29 from improperly being lifted up or dropping off the belt attachment 29 even when the opening facing the belt attachment 29 is enlarged by providing the cutout 25.

Since the outline of the cutout 25 is formed along the inner shape of the legs 12 and the connecting portion 15, neither the legs 12 nor the connecting portion 15 is exposed out of the cutout, so that, for instance, the legs 12 or the connecting portion 15 is prevented from being caught by other articles.

The protrusion 25B projecting into the housing space 23 is formed inside the body 21. Since the protrusion 25B is continuously formed over a predetermined area along the edge of the cutout 25 near the insertion opening 22, when the engaging portion 14 comes too close to the central axis of the socket 20, the protrusion 25B blocks the engaging portion 14 to prevent the plug 10 from being inserted into the socket 20 while the plug 10 being too tilted.

While the legs of the plug 10 is inserted from the insertion opening 22 of the socket 20 for coupling, when the plug 10 is too tilted relative to the insertion direction (see FIG. 9), the protrusion 25B blocks the engaging portion 14 to prevent the plug 10 from being inserted into the socket 20 while the plug 10 being too tilted, whereby a pair of engaging portions 14 can be guided to the respective engaged portions 24 only when the plug 10 is in a suitable posture. Thus, the plug 10 is smoothly inserted into the socket 20.

With the undulation 26 formed on the body 21 of the socket 20, rigidity of the body 21 can be enhanced without changing a thickness thereof. Particularly, against such a possible deformation of the socket 20 of the side release buckle 1 caused by being crushed by press in the top-bottom direction, the undulation 26 generates bending rigidity based on the cross section thereof, thereby effectively suppressing deformation of the body 21. Particularly, because the undulations 26 are present substantially at the center which is easily cracked by force in a crushing direction, the socket 20 is prevented from cracking and becomes unlikely to be broken.

Moreover, since the undulations 26 reliably provide rigidity, a thickness of the socket 20 can be thinned, so that costs can be reduced by reduction in usage of synthetic resin materials and a weight of the buckle can be reduced.

Further, since the undulations 26 are formed in the insertion direction of the legs 12, the undulations 26 are configured to have no interference with an insertion operation of the legs 12 and also to have a guiding function for the engaging portions 14 of the legs 12 and the guided portions 16.

Each of the undulations 26 includes the linear concave 26A and the linear convex 26B, the linear concave 26A being formed on the outer surface of the body 21, the linear convex 26B being formed on the inner surface thereof. In other words, the undulations 26 are provided by forming the top and bottom surfaces of the body 21 in a corrugated plate. Accordingly, each of the undulations 26 has a substantially constant thickness on the top or bottom surface of the body to avoid an increase in weight and to reduce a possible generation of sink marks and the like in synthetic resin formation.

In addition, since the linear concave 26A is defined as the outer surface of the body 21, the body 21 has no outward projection, which gives a simple appearance of the body 21.

The undulations 26 are provided in a projecting manner between portions of the housing space 23 in which the legs 12 are housed. Accordingly, when the pair of legs 12 are inserted into the housing space 23, the legs 12 enter both the lateral portions of the undulations 26 without mutual interference. Consequently, a thickness (a dimension in the top-bottom direction of the buckle) of each of the legs 12 and the undulations 26 can be increased, which is effective in securing strength.

Moreover, the undulations 26 also serve as a guide to guide the engaging portions 14 to the engaged portions 24 when the legs 12 are inserted therein, which allows the plug 10 and the socket 20 to be easily and reliably engaged with each other.

Second Exemplary Embodiment

Figure 10:
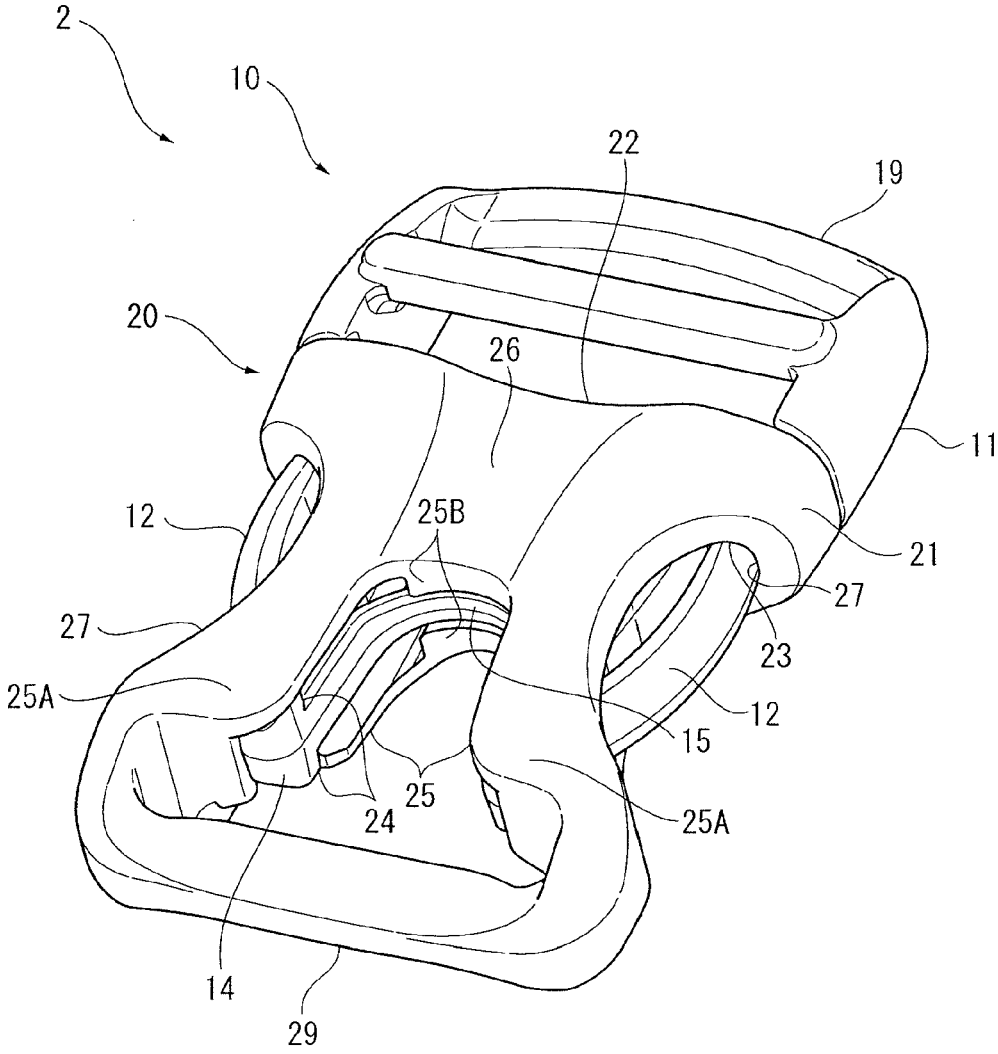
FIG. 10 is a perspective view showing a top surface of a side release buckle according to a second exemplary embodiment of the invention.

FIG. 10 shows a second exemplary embodiment of the invention.

A side release buckle 2 according to this exemplary embodiment includes the same plug 10 and the socket 20 as those in the first exemplary embodiment. According to this exemplary embodiment, although the cutout 25 is formed on the socket 20 near the belt attachment 29, the cutout 28 as shown in the first exemplary embodiment (see FIG. 1) is not formed. The undulation 26, which is longer than that in the first exemplary embodiment by a length of the cutout 28, is continuously formed from the edge of the insertion opening 22.

Since the cutout 28 in FIG. 1 is not provided, this exemplary embodiment is not effective in reducing the material and the weight of the body 21. However, except for this, the same advantages (produced by the cutout 25, the protrusion 25B and the like) as those in the first exemplary embodiment can be obtained. Further, the longer undulation 26 according to this exemplary embodiment can enhance the rigidity of body 21 more than the undulation 26 according to the first exemplary embodiment.

Modifications

It should be noted that the invention is not limited to the above arrangements of the exemplary embodiments but encompasses the following modifications.

A shape of each of the cutouts 25 and 28 is not limited to a U-shape or a C-shape, but may be a V-shape or rectangular. However, when the most inward parts of the cutouts 25 and 28 are shaped in an arc such as a U-shape or a C-shape, unnecessary stress concentration can be avoided and such a shape is suitable for attaining the strength.

The protrusion 25B and the connecting portion 15 may provide a stepwise surface. Specifically, the protrusion 25B may be withdrawn into the housing space 23 relative to the connecting portion 15, or the connecting portion 15 may be withdrawn into the housing space 23 relative to the protrusion 25B.

The protrusion 25B is not limited to the continuous protrusion having a rectangular cross section, but may be one having a semicircular cross section or a triangular cross section. Moreover, the protrusion 25B is not limited to the continuous protrusion, but may be a discontinuous protrusion.

The area over which the protrusion 25B extends on the edge of the cutout 25 may be determined as needed. Alternatively, the protrusion 25B may be omitted.

In addition, detailed shapes and structures of the plug 10 and the socket 20 can be changed as needed. A dimension, material, color, surface finish of each of the plug 10 and the socket 20 can be selected as needed in implementation of the invention.

The invention claimed is:

1. A side release buckle, comprising:

(a) a plug, comprising (i) a base including a belt attachment, (ii) a pair of legs projecting from the base, each leg including an engaging portion, and (iii) a connecting portion extending between the pair of legs and connected to each leg, wherein the connecting portion defines an at least partially open area partially surrounded by the connecting portion; and (b) a socket configured to receive the plug through an insertion opening and into an engaged configuration, the socket comprising a belt attachment, a top portion extending from a forwardmost part of the top portion at the insertion opening to a rearmost part of the top portion, a bottom portion extending from a forwardmost part of the bottom portion at the insertion opening to a rearmost part of the bottom portion, and two sides connecting the top portion to the bottom portion, the socket further comprising a top portion cutout area between the rearmost part of the top portion and the belt attachment and a bottom portion cutout area between the rearmost part of the bottom portion and the belt attachment, wherein the bottom portion cutout area is larger than the top portion cutout area such that, when the plug and the socket are in the engaged configuration, the top portion of the socket covers at least a portion of the engaging portions of the pair of legs and the bottom portion of the socket does not cover the engaging portions of the pair of legs;

wherein, when the plug and the socket are in the engaged configuration, at least one of the top portion and bottom portion cutout areas of the socket at least partially overlaps the open area of the plug.

2. The side release buckle of claim 1, wherein the engaging portion of each leg is located proximate a distal tip of the leg.

3. The side release buckle of claim 1, wherein the connecting portion surrounds three sides of the open area.

4. The side release buckle of claim 1, wherein the socket further comprises four engaged portions configured to engage the engaging portions of the pair of legs when the plug and the socket are in the engaged configuration.

5. The side release buckle of claim 4, wherein two of the engaged portions of the socket are inset relative to the rearmost part of the top portion and the other two of the engaged portions of the socket are proximate the rearmost part of the bottom portion.

6. The side release buckle of claim 1, wherein a central portion of an outer surface of at least one of the top portion and bottom portion of the socket is recessed relative to outer portions of the outer surface.

7. The side release buckle of claim 1, wherein the connecting portion of the plug is connected to each leg at a distal tip of the leg.

8. The side release buckle of claim 7, wherein, when the plug and the socket are in the engaged configuration, at least one of the top portion and bottom portion cutout areas extends closer to the insertion opening than the distal tips of the legs of the plug.

9. The side release buckle of claim 1, wherein the socket further comprises a pair of projections extending downwardly from the top portion of the socket, proximate the top portion cutout area, such that when the plug and the socket are in the engaged configuration, each of the pair of projections covers at least a portion of a distal end of one of the legs.

10. A side release buckle, comprising:

(a) a plug comprising a base and a pair of legs projecting from the base, each leg including an engaging portion; and (b) a socket configured to receive the plug through an insertion opening and into an engaged configuration, the socket comprising a belt attachment, a top portion extending from a forwardmost part of the top portion at the insertion opening to a rearmost part of the top portion, a bottom portion extending from a forwardmost part of the bottom portion at the insertion opening to a rearmost part of the bottom portion, and two sides connecting the top portion to the bottom portion, the socket further defining a top portion cutout area between the rearmost part of the top portion and the belt attachment, and a bottom portion cutout area between the rearmost part of the bottom portion and the belt attachment, the socket further comprising two engaged portions positioned in an interior of the socket and inset relative to the rearmost part of the top portion and two engaged portions formed in the interior of the socket and positioned proximate the rearmost part of the bottom portion, wherein the engaged portions of the socket are configured to engage the engaging portions of the plug when the plug and the socket are in the engaged configuration, and wherein the bottom portion cutout area is larger than the top portion cutout area such that, when the plug and the socket are in the engaged configuration, the top portion of the socket covers at least a portion of the engaging portions of the pair of legs and the bottom portion of the socket does not cover the engaging portions of the pair of legs.

11. The side release buckle of claim 10, wherein the engaging portion of each leg of the plug is proximate a distal tip of the leg.

12. The side release buckle of claim 10, wherein the engaged portions of the socket are steps formed on an interior surface of the socket.

13. The side release buckle of claim 10, wherein the plug further comprises a connecting portion extending between the pair of legs and connected to each leg proximate the engaging portion of each leg.

14. The side release buckle of claim 10, wherein a central portion of an outer surface of at least one of the top portion and the bottom portion of the socket is recessed relative to outer portions of the outer surface.

15. The side release buckle of claim 10, wherein each of the legs of the plug further comprises distal tips, wherein, when the plug and the socket are in the engaged configuration, at least one of the top portion and bottom portion cutout areas extends closer to the insertion opening than the distal tips of the legs of the plug.

16. The side release buckle of claim 10, wherein the socket further comprises a pair of projections extending downwardly from the top portion of the socket, proximate the top portion cutout area, such that when the plug and the socket are in the engaged configuration, each of the pair of projections covers at least a portion of a distal end of one of the legs.

* * * * *